United States Patent [19]

Werner-Larsen

[11] 4,455,131

[45] Jun. 19, 1984

[54] CONTROL DEVICE IN A HELICAL SCREW ROTOR MACHINE FOR REGULATING THE CAPACITY AND THE BUILT-IN VOLUME RATIO OF THE MACHINE

[75] Inventor: Olaf Werner-Larsen, Nacka, Sweden

[73] Assignee: Svenska Rotor Maskiner Aktiebolag, Nacka, Sweden

[21] Appl. No.: 317,469

[22] Filed: Nov. 2, 1981

[51] Int. Cl.[3] ..... F01C 1/16; F01C 21/12; F04B 29/00

[52] U.S. Cl. ..... 418/201; 417/440

[58] Field of Search ..... 418/201, 202, 203, 159; 417/310, 440

[56] References Cited

U.S. PATENT DOCUMENTS 3,088,659 5/1963 Nilsson et al. ..... 418/159

FOREIGN PATENT DOCUMENTS 959831 6/1964 United Kingdom ..... 418/159

*Primary Examiner*—Leonard E. Smith

*Assistant Examiner*—Jane E. Obee

*Attorney, Agent, or Firm*—Frishauf, Holtz, Goodman & Woodward

[57] ABSTRACT

A control device for regulating the capacity and the built-in volume ratio of a helical screw rotor machine comprises at least one additional valve member which is axially aligned with first and second valve members in the screw rotor machine, the additional valve member being movable between the positions in which said additional valve member contacts one or both of said first and second valve members to form an extension of either or both of the first and second valve members. The additional, first and the second valve members are connected to the operating device to permit displacement thereof. This permits varying the length of the second valve member (the slide valve) in one or more steps, which in turn means that it is possible to displace the gap between the first and second valve members without moving the high pressure end of the second valve member (the slide valve).

6 Claims, 8 Drawing Figures

1
2
3
4
5
6
7
8
9
13
19
21
22
25
26
27
28
29

CONTROL DEVICE IN A HELICAL SCREW ROTOR MACHINE FOR REGULATING THE CAPACITY AND THE BUILT-IN VOLUME RATIO OF THE MACHINE

BACKGROUND OF THE INVENTION

The invention relates to a control device in a helical screw rotor machine for elastic fluid comprising a casing provided with a barrel portion defined by intersecting bores with parallel axes located between axially spaced end walls of the casing and having inlet and outlet ports communicating with the bores, each rotor having helical lands and intervening grooves, the male rotor lands having their major portions radially outside the pitch circle of the male rotor and with convexly curved flanks, and the female rotor lands having their major portions radially inside the pitch circle of the female rotor and with concavely curved flanks. The lands and grooves of the rotors are intermeshing to form with the bores chevron-shaped working chambers each comprising communicating portions of a male and a female groove, the chevron-shaped chambers being defined at their base ends by the stationary end walls of the casing and at their apex ends by the intermeshing lands of the rotors, the volumes of said chevron-shaped chambers being varied as the rotors revolve. A valve means is provided which comprises a first and a second axially aligned and separately operated valve member for regulating the quantity of elastic fluid passing through the machine and the pressure ratio thereof, respectively, said valve members being slidable in an axially extending recess formed in the casing so as to open directly into the bores, the valve members having an inner face of shape complementary to the envelope of that portion of the bores confronted by the opening of the recess and adapted to control an opening venting the working chamber to the inlet port and the area of the outlet port.

It is known to regulate the capacity of a compressor of this type by using a single slidable valve member by means of which the initial and final volumes of the chevron-shaped working chambers are varied. Thus, when the capacity is varied, the built-in pressure ratio or volume ratio is varied as well.

This means for instance that when the capacity is decreased to a low value, the built-in pressure ratio or volume ratio is increased at the same time to an unsuitably high value, resulting in a reduced efficiency.

In order to at least reduce this drawback, it is suggested in U.S. Pat. No. 3,088,659, FIG. 8, to utilize a valve means comprising first and second axially aligned and separately operated valve members one of which—called a movable slide stop—is used for regulating the capacity and the other—called a slide valve is used for regulating the pressure ratio or volume ratio. The slide stop of U.S. Pat. No. 3,088,659 opens a recirculation slit to the inlet port in which case the machine is run at part load, i.e. part of the air or gas will be bled from the working chambers back to the inlet port via the recirculation slit. The volumetric flow drawn by the machine through the inlet port is dependent on the size of the recirculation slit and the position of the slide valve. Both of these factors will also affect the matching of the inner compression pressure to the external pressure ratio. Thus, the size of the recirculation slit as well as the position of the slide valve both affect the capacity of the machine. Different part-load capacities can be achieved with different combinations of slit size and slide valve position but only one combination in this range provides the best efficiency.

A special disadvantage of the movable slide stop occurs at high pressure ratios. Under such conditions the slide valve is moved far towards the outlet end. The recirculation gap between the slide stop and the slide valve will then be locate relatively late in the compression process. Losses will be incurred due to the fact that the compression work has been done on the gas which is recirculated back to the inlet port through the recirculation slit. These losses obviously occur in all machines of this type provided with slide valve control. However, in this particular case the losses will be higher than usual since the gap is positioned so late in the compression process.

The object of the present invention is to eliminate these drawbacks and to make it possible to run the machine under at least two different part-load conditions with best efficiency. This is especially important in refrigeration applications. In refrigerated cargo ships, for instance, different cargoes must be maintained at different temperatures. In case of fruit shipments, the temperature may even have to be varied in accordance with a certain pattern during the course of the journey. The evaporation temperature of the refrigeration system must apparently also differ on different occasions.

In freezer, refrigeration or air conditioning installations employing air-cooled condensers, the condensation temperature of the system varies with the season of the year so that it is high during the summer and low in winter. In the case of water-cooled condensers the water temperature and thus also the condensation temperature sometimes vary with the season of the year, depending on the source of the cooling water.

In the case of heat pumps, the energy-absorber temperature often varies with the season of the year.

SUMMARY OF THE INVENTION

The improvement according to the invention resides in the provision of at least one additional valve member, which is axially aligned with the abovementioned first and second valve members and movable between the positions in which said additional valve member contacts one or both of said first and second valve members to form an extension of optionally either or both of said first and second of said valve members. Said additional and first and second valve members are connected to an operating device adapted to permit displacement thereof. Hence, it is possible to vary the length of the second valve member (the slide valve member) in one or more steps, which in turn means that it is possible to displace the gap between the first and second valve members without moving the high pressure end of the second valve member (the slide valve member).

A number of embodiments of a screw rotor machine of the type specified and modified in accordance with the invention will now be particularly described by way of example with reference to the accompanying drawings.

FIG. 1 is a longitudinal section through a first embodiment of the invention, and FIGS. 2 to 5, respectively, are similar schematic sections showing different means for operating the valve members, and FIGS. 2*a*–2*c* illustrate different operating conditions for the embodiment shown in FIG. 2.

DETAILED DESCRIPTION

Figure 1:
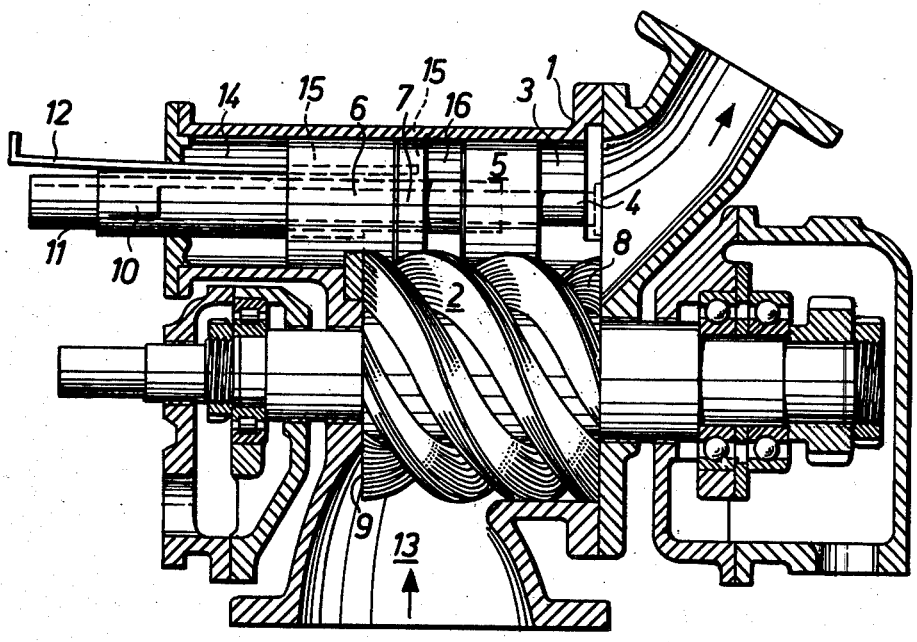

It will be seen from the drawings that the machine illustrated is a compressor of the well known type comprising a casing 1 and two rotatably journalled rotors 2 each having helical lands and intervening grooves, viz. a male rotor having helical lands with convexly curved flanks located substantially outside the pitch circle of the rotor, and a female rotor having helical lands with concavely curved flanks located substantially inside the pitch circle of the rotor, the lands and grooves of the rotors intermeshing to form with the bores of the casing the usual well known chevron-shaped working chambers.

In a bore 3 of the casing 1 a guide rod 4 is fixedly mounted for slidable journalling of three separate valve members, for example a conventional slide valve member 5, a conventional slide stop valve member 6 and an additional valve member 7 adjacent to and contacting slide stop valve member 6. The valve members are situated on the same side of the plane through the axes of the rotors 2 as a high pressure port 8. The slide stop valve member 6 extends out through a low pressure end wall 9 and is adjusted by displacement of a tube 10. The slide valve member 5 is located between the additional valve member 7 (which in the position shown can be considered as an extension of the slide stop valve member 6) and the port 8, and is adjusted by means of a rod 11. The additional valve member 7 is adjusted by means of a rod 12.

A low pressure duct 13 communicates with a space 14 off the slide stop valve member 6 in FIG. 1, which space in turn communicates through a passage 15 of contacting valve members 6 and 7 with a space 16 between valve members 5 and 7.

In order to get a small absorption of power from a driving motor (not shown) at start and at idling, the slide stop valve member 6 and contacting valve member 7 can be displaced through the low pressure end wall 9. In this way uncompressed working fluid escapes from the working space back to the low pressure duct 13 during the first part of the compression stroke simultaneously as the part of the rotors 2 covered by the slide valve member 5 is comparatively short. In this way the mass of the working fluid passing through the machine is small, and the internal compression is also low so that the absorbed power is negligible.

When all three valve members 5, 6, 7 are moved in contact with each other to form a single unit, maximum capacity is obtained and the pressure ratio can be adjusted without affecting the capacity of the machine by displacement of the unit formed by valve members 5, 6, 7. Part-load (reduced capacity) is then obtained by separating the slide stop member 6 from valve members 5 and 7, in which case a comparatively high pressure ratio is obtainable. A reduction of the pressure ratio is obtained by moving the valve member 7 into contact with the slide stop valve member 6.

A two-step regulation can be obtained if a further additional valve member is utilized and operated (not shown) in a similar way as valve member 7.

FIGS. 2, 3, 4 and 5 disclose different means for operating the different valve members 5, 6, 7.

Figures 2, 2A, 2B, 2C:
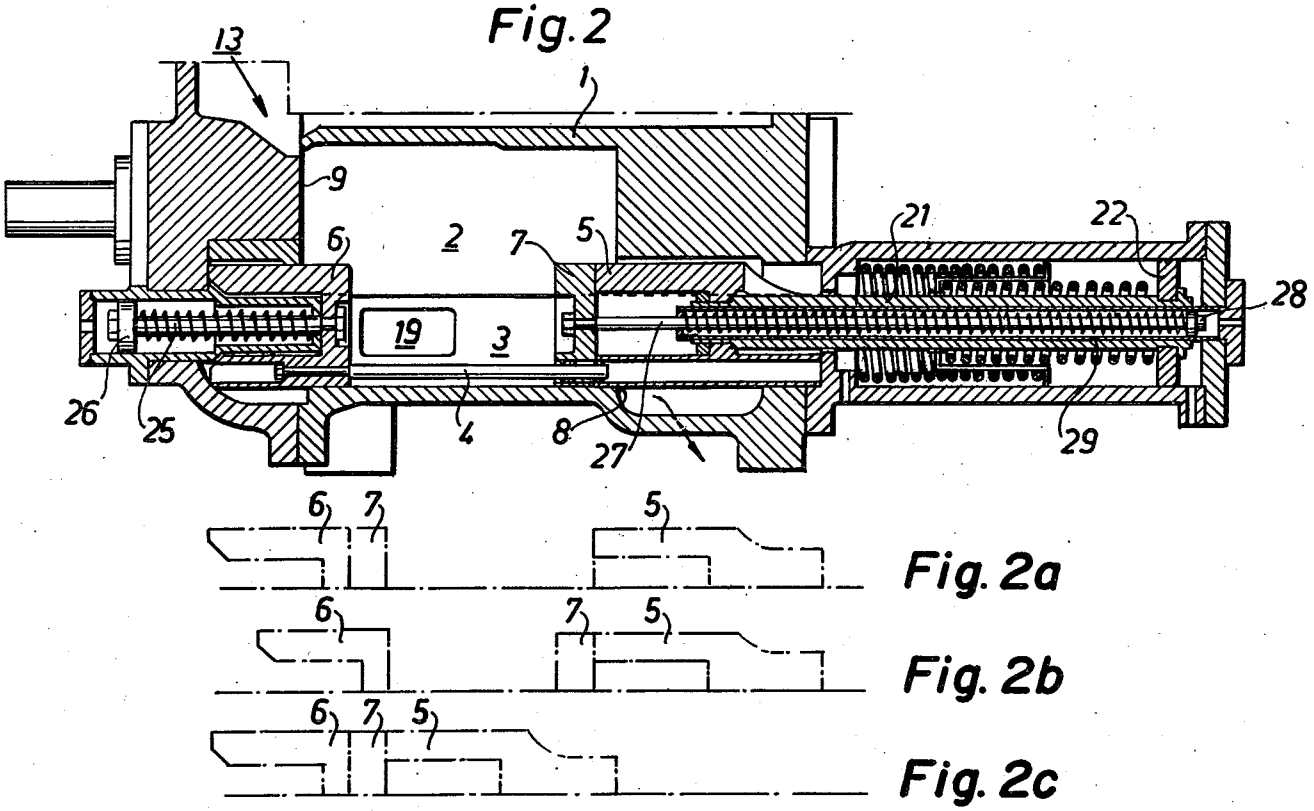

In FIG. 2 valve member 5 is operated via a tube 21 by a hydraulic power piston 22. The movable slide stop valve member 6 is operated via a rod 25 by a power piston 26. The additional valve member 7 is in contact with valve member 5 and is operated via a rod 27 by a power piston 28 slidable in a fixedly mounted cylinder 29.

Figure 3:
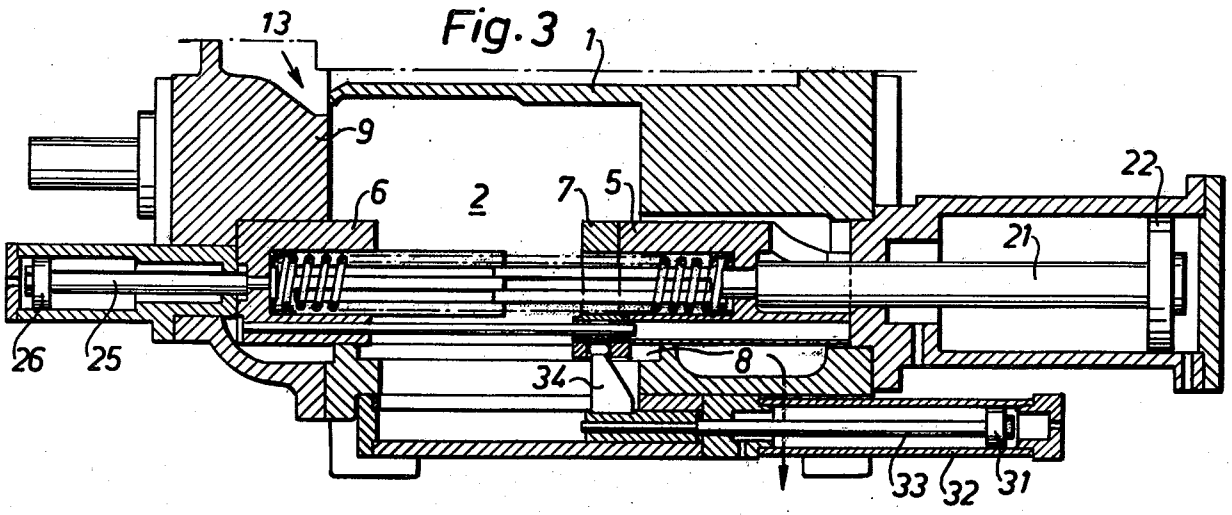

The embodiment shown in FIG. 3 differs mainly from FIG. 2 in that the additional valve member 7 is operated by an external power piston 31 and cylinder 32. Piston 31 is connected to valve member 7 via a piston rod 33 and a finger 34

Figure 4:
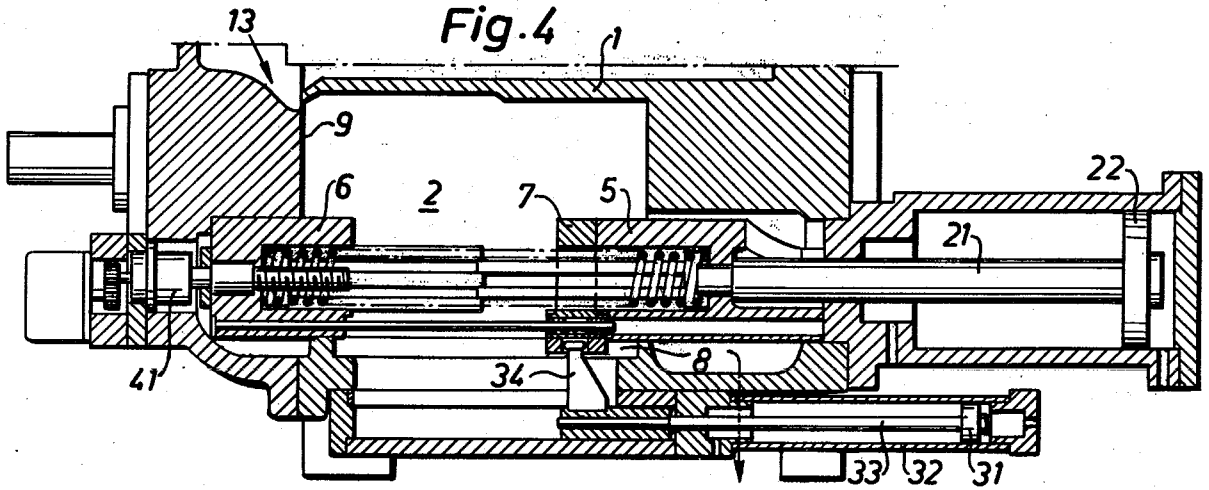

The embodiment shown in FIG. 4 differs mainly from FIG. 3 in that the movable slide stop valve member 6 is operated by an electric motor 41 by means of which the slide stop valve member can be displaced step-by-step.

Figure 5:
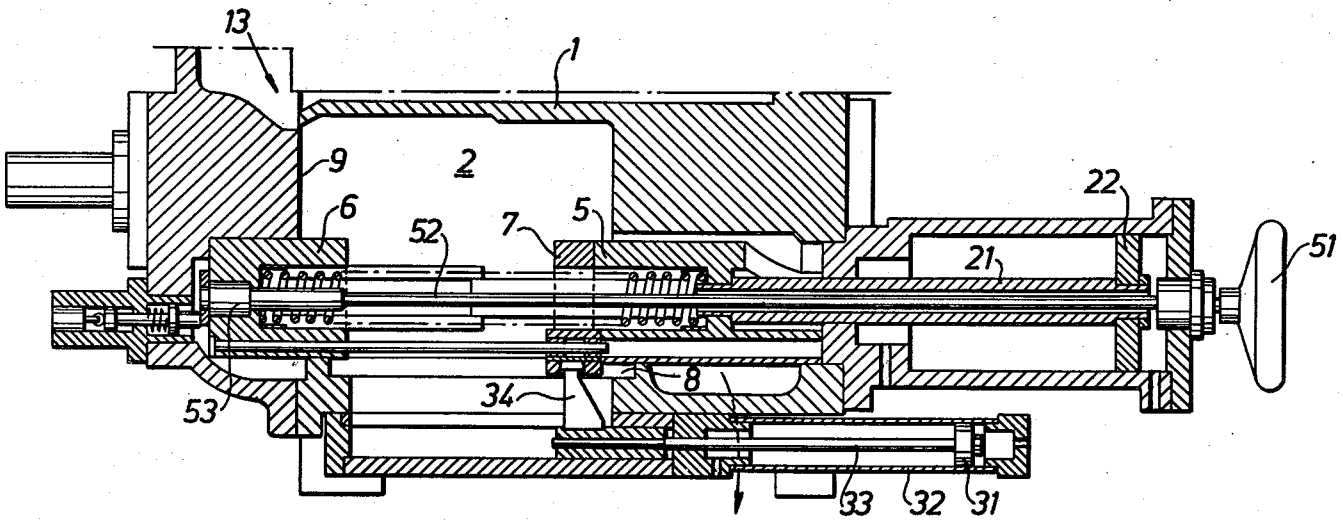

The embodiment shown in FIG. 5 differs from FIGS. 3 and 4 mainly in that the movable slide stop valve member 6 is operated by means of a hand-operated wheel 51 connected to the slide stop valve member 6 via a rod 52 and a screw mechanism 53 for displacing the slide stop valve member 6 by turning the hand-wheel 51.

The positions of the different valve members 5, 6 and 7 for the FIG. 2 embodiment are indicated FIGS. 2*a*, 2*b* and 2*c* which indicate idling condition, part-load condition and full-load condition, respectively.

In FIGS. 2 to 5 an opening 19 in casing 1 communicates with the low pressure duct 13.

I claim:

1. A control device in a helical screw rotor machine for elastic fluid comprising a casing provided with a barrel portion defined by intersecting bores with parallel axes located between axially spaced end walls of the casing and having inlet and outlet ports communicating with the bores, each rotor having helical lands and intervening grooves, the male rotor lands having their major portions radially outside the pitch circle of the male rotor and with convexly curved flanks, the female rotor lands having their major portions radially inside the pitch circle of the female rotor and with concavely curved flanks, the lands and grooves of the rotors intermeshing to form with the bores chevron-shaped working chambers each comprising communicating portions of a male and a female rotor groove, the chevron-shaped chambers being defined at their base ends by the stationary end walls of the casing and at their apex ends by the intermeshing lands of the rotors, the volumes of said chevron-shaped chambers being varied as the rotors revolve, and a valve means comprising a first and a second axially aligned and separately operated valve member for regulating the quantity of elastic fluid passing through the machine and the pressure ratio thereof, respectively, said valve members being slidable in an axially extending recess formed in the casing so as to open directly into the bores, the valve members having an inner face of shape complementary to the envelope of that portion of the bores confronted by the opening of the recess and adapted to control an opening venting the working chamber to the inlet port and the area of the outlet port, characterized by at least one additional valve member which is axially aligned with said first and second valve members and movable between them in contact with the end of either of them to form an extension of either of said valve members, which additional and first and second valve members, respectively, are connected to an operating device adapted to permit displacement of all the valve members.

2. The control device of claim 1, wherein said additional, first and second valve members, respectively, are connected to said operating device to permit displacement of all of the valve members separately.

3. The control device of claim 1, wherein said additional, first and second valve members, respectively, are connected to said operating device to permit displacement of at least two of said valve members attached to each other, together as a unit.

4. The control device of claim 1, wherein said additional, first and second valve members, respectively, are connected to said operating device to permit displacement of all of the valve members, with at least two of the valve members attached to each other, together as a unit.

5. The control device of claim 1, wherein said at least one additional valve member is in contact with an end of said first valve member to form an extension of said first valve member.

6. The control device of claim 1, wherein said at least one additional valve member is in contact with an end of said second valve member to form an extension of said second valve member.

* * * * *